US005442913A

United States Patent [19]

Cho et al.

[11] Patent Number: 5,442,913

[45] Date of Patent: Aug. 22, 1995

[54] STIRLING CYCLE SYSTEM DRIVING DEVICE

[75] Inventors: Gwan S. Cho; Seok M. Jang, both of Seoul; Dong G. Shin, Gyeonggi, all of Rep. of Korea

[73] Assignee: Goldstar Co., Ltd., Seoul, Rep. of Korea

[21] Appl. No.: 172,564

[22] Filed: Dec. 21, 1993

[30] Foreign Application Priority Data

Dec. 29, 1992 [KR] Rep. of Korea ..... U92-27382
Apr. 29, 1993 [KR] Rep. of Korea ..... P93-7306
Jun. 4, 1993 [KR] Rep. of Korea ..... P93-10111

[51] Int. Cl.[6] ..... F02G 1/043
[52] U.S. Cl. ..... 60/518; 60/519
[58] Field of Search ..... 60/517, 518, 519, 525, 60/526

[56] References Cited

U.S. PATENT DOCUMENTS 2,475,770 7/1949 Wijsman ..... 60/525
3,385,051 5/1968 Kelly ..... 60/525
3,403,508 10/1968 Kelly ..... 60/525
3,407,593 10/1968 Kelly ..... 60/525
4,413,474 11/1983 Moscrip ..... 60/517
4,698,970 10/1987 Hashimoto ..... 60/525

*Primary Examiner*—Ira S. Lazarus
*Assistant Examiner*—L. Heyman
*Attorney, Agent, or Firm*—Christie, Parker & Hale

[57] ABSTRACT

A stirling cycle system driving device comprises a circumference cam having a circumferential guiding groove formed in the outer peripheral surface thereof, a piston rod and a displacer rod respectively having a wheel guided along said circumferential guiding groove, a crank case having guiding grooves for guiding said piston rod and said displacer rod only upward and downward, a piston and a displacer, and a cylinder case. According to the present invention, because a crank shaft is not needed, the device can be minified and the quantity of the working fluid can be decreased. Preferably, the device further comprises a following gear connected to the displacer rod and the piston rod, a driving gear engaged with said following gear, and a control motor for driving said driving gear, by which the phase angle between the piston and the displacer can be regulated.

12 Claims, 8 Drawing Sheets

STIRLING CYCLE SYSTEM DRIVING DEVICE

BACKGROUND OF THE INVENTION

1. Technical Field

The present invention relates to a stirling cycle system driving device, and more particularly to a stirling cycle system driving device having circumference cams instead of a crank shaft so that the device can be compact and the quantity of working fluid can be decreased, in which device a phase angle between a displacer rod and a piston rod can be regulated so that the output power of the device can be regulated even after fabrication of the device, and in which device a vibration due to the gap of a cam guiding groove is restrained and one side wearing of surfaces of a cam guiding groove is prevented.

2. Prior art

FIG. 1 shows a conventional stirling cycle system driving device having a crank shaft c. If a tool phase angle $\alpha$ is set in the crank shaft C and the crank shaft C is rotated, a displacer D and a piston P connected to the respective ends of crank arms move upward and downward linearly, and a track of volume changing to have a desired volume phase angle $\beta$ is produced by the reciprocal action of the displacer D and the piston P, thereby the system is driven. In this case, said tool phase angle $\alpha$ means the angle between the crank arms respectively connected to the displacer D and the piston P, and said volume phase angle $\beta$ means the difference between a rotation angle of the crank shaft to the top point I of the stroke of the displacer and that to the top point II of the stroke of the piston. In FIG. 1, the axis X indicates a rotation angle of the crank shaft, and the axis Y indicates strokes of the displacer and the piston.

A conventional stirling cycle system driving device as described above has several defects as follows:

1. A crank shaft is included in the device, and a space larger than the rotating radius of the crank arms is needed for a crank chamber within which the crank shaft and the crank arms rotate, thereby it is difficult for the device to be compact.

2. Due to the same reason as in the defect 1, the quantity of working fluid must be increased, thereby the manufacturing cost is increased.

3. A separate procedure for manufacturing a crank chamber must be added.

4. The tool phase angle $\alpha$ of the crank shaft must be changed to revise the volume phase angle $\beta$ for performance compensation of the device, and the crank shaft must be remanufactured to change the tool phase angle $\alpha$, thereby the development and the modification of the device are considerably difficult.

Meanwhile, U.S. patent Ser. No. 3,940,932 granted to Ambrose et al. discloses a stirling cycle system using cam grooves. Said Patented system has a construction that a power piston and a recovery piston are spaced apart from each other and the respective piston rollers can be contact with cam grooves formed in a fly wheel, thereby the temperature difference between the hot and the cold sides of the system is increased so that power loss is decreased and efficiency is improved. However, there are shortcomings that said system requires much more space than a convectional stirling cycle system using a crank shaft due to the separated construction of the power piston and the recovery piston, and that a steady output of power is not produced because piston rollers and cam grooves are not steadily in contact with each other.

SUMMARY OF THE INVENTION

An object of the invention is to provide a stirling cycle system driving device by which the system can be compact and the manufacturing cost can be reduced through the reduction of the quantity of the working fluid, and the development and the modification of which can be easily achieved.

Another object of the present invention is to provide a stirling cycle system driving device in which the phase angle between displacer rods and piston rods can be regulated so that the output power can be regulated even after the device is fabricated.

Another object of the present invention is to provide a stirling cycle system driving device in which the vibration due to the gaps of the cam grooves is restrained and the one side wearing of surfaces of the cam guiding groove is prevented.

To achieve the above objects, a stirling cycle system driving device according to the present invention comprises:

a circumference cam having a power shaft connected to incorporate said circumference cam for transmitting a rotating force, and at least one circumferential guiding groove formed on the outer peripheral surface of said circumference cam;

at least one piston rod and at least one displacer rod respectively having a wheel engaged in said circumferential guiding groove, said wheel guided along said circumferential guiding groove by the rotation of said circumference cam;

a crank case including at least one piston rod guiding groove and at least one displacer rod guiding groove which are spaced out at a predetermined circumferential interval apart, and which respectively guide said piston rod and said displacer rod so that said piston rod and said displacer rod can only reciprocate upward and downward;

a piston and a displacer which are respectively connected to said piston rod and said displacer rod, and which reciprocate upward and downward when said wheels are guided along said circumferential guiding groove by the rotation of said circumference cam; and a cylinder case enclosing said piston and said displacer, and including an expansion space defined by said displacer and said cylinder case, and a compression space defined by said displacer and said piston.

Preferably, a stirling cycle system driving device according to the present invention further comprises regulating means for regulating the circumferential interval between said piston rod guiding groove and said displacer rod guiding groove.

Further, it is preferred that a stirling cycle system driving device according to the present invention further comprises a connecting line interconnecting said compression space and the interior space of said crank case; and a counterflow preventing valve which is disposed midway of the connecting line and prevents the working fluid from flowing from said compression space to the interior space of said crank case.

BRIEF DESCRIPTION OF THE DRAWINGS

The above objects and other features and advantages of the present invention will become more apparent by describing the preferred embodiments thereof with reference to the accompanying drawings, in which.

DETAILED DESCRIPTION OF THE PREFERRED EMBODIMENTS

Figure 2:
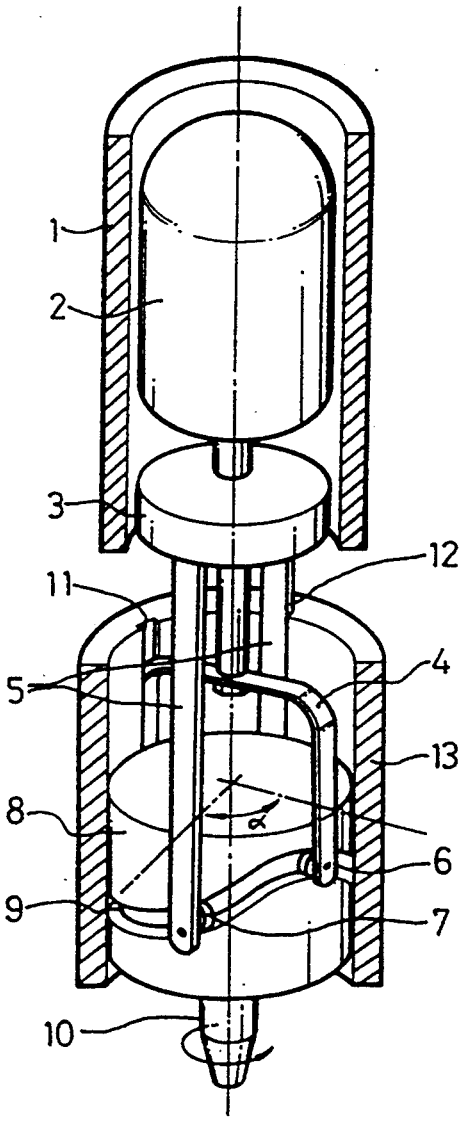
FIG. 2 is a partially cutaway perspective view showing the construction of a device according to one embodiment of the present invention.

FIG. 2 is a partially cutaway perspective view showing the construction of a device according to one embodiment of the present invention, said device comprises a circumference cam 8 to which a power shaft 10 is connected and the outer peripheral surface of which has a circumferential guiding groove 9 formed, and displacer rods 4 and piston rods 5 respectively including wheels engaged in said circumferential guiding groove 9 of said circumference cam 8 and guided in said circumferential guiding groove 9 by the rotation of the circumference cam 8. To the displacer rods 4 and the piston rods 5 are connected respectively a displacer 2 and a piston 3 which reciprocate upward and downward in cylinder case 1. A displacer rod guiding groove 11 and a piston rod guiding groove 12 respectively are formed longitudinally in the inner surface of a crank case 13, and one of said displacer rods 4 and one of said piston rods 5 are engaged respectively in said grooves 11, 12 so that the displacer rods 4 and the piston rods 5 can perform only linear movements. The displacer rod guiding groove 11 and the piston rod guiding groove 12 are spaced out at a predetermined circumferential interval apart, thereby the displacer rods and the piston rods together form an angle which is equivalent to the forementioned tool phase angle $\alpha$.

Figure 4:
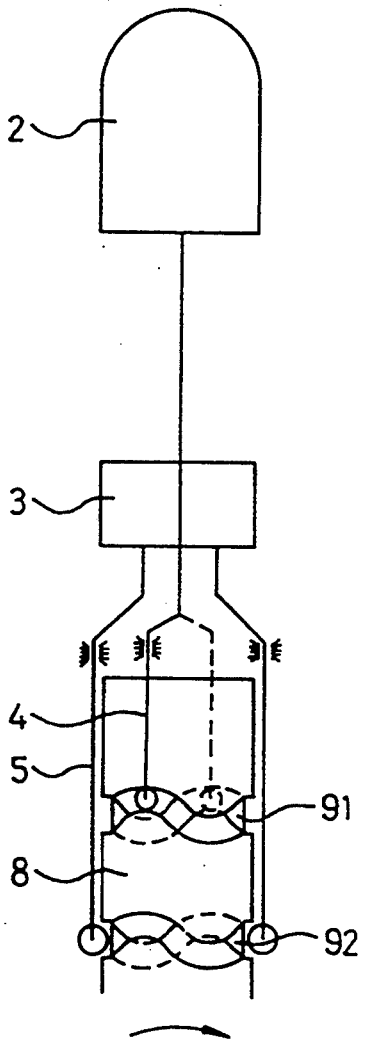
FIG. 4 and 5 are constructional views of devices according to other embodiments of the present invention.
Figure 5:
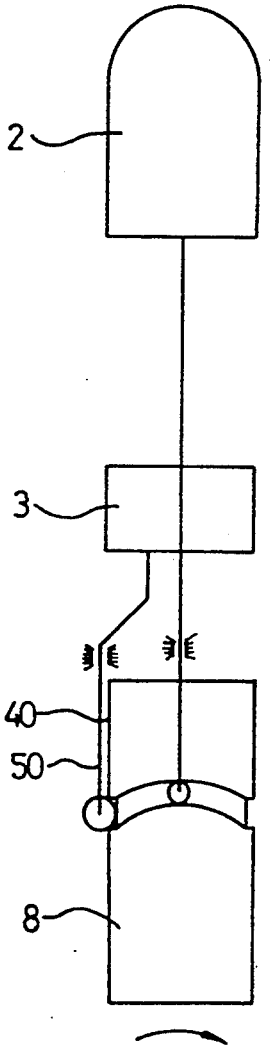

Meanwhile, FIG. 2 shows a stirling cycle system driving device having two piston rods 5 and two displacer rods 4, while the stirling cycle system driving device may have one displacer rod 40 and one piston rod 50 as shown in FIG. 5. Further, FIG. 2 shows that wheels 6 of displacer rods 4 and wheels 7 of piston rods 3 are engaged in one circumferential guiding groove 9, while two circumferential guiding grooves 91, 92 are formed in the outer peripheral surface of the circumference cam 8, and wheels 6 of displacer rods 4 may be engaged in one of said grooves 91, 92 and wheels 7 of piston rods 3 may be engaged in the other of said grooves, as shown in FIG. 4.

Figure 6:
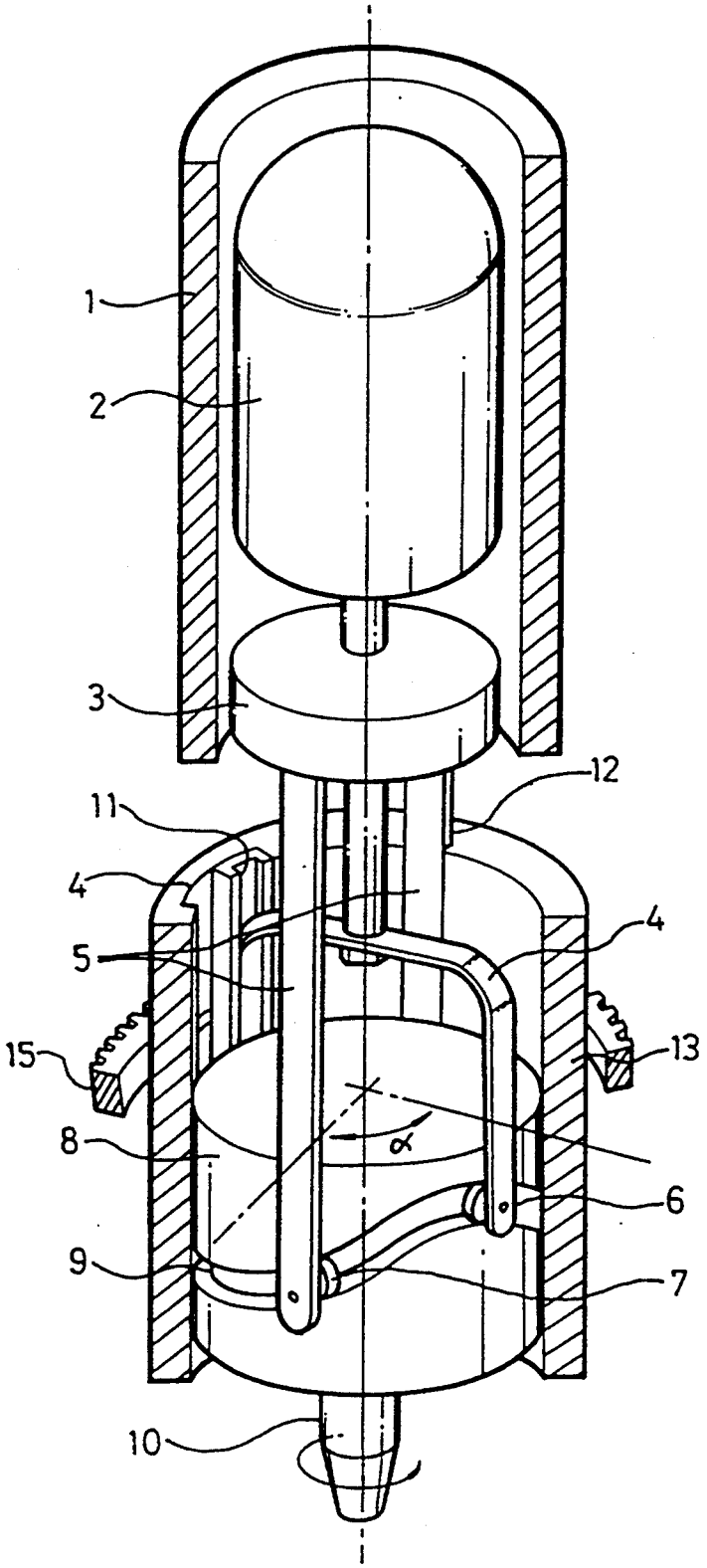
FIG. 6 is a partially cutaway perspective view showing the construction of a device according to another embodiment of the present invention.
Figure 7:
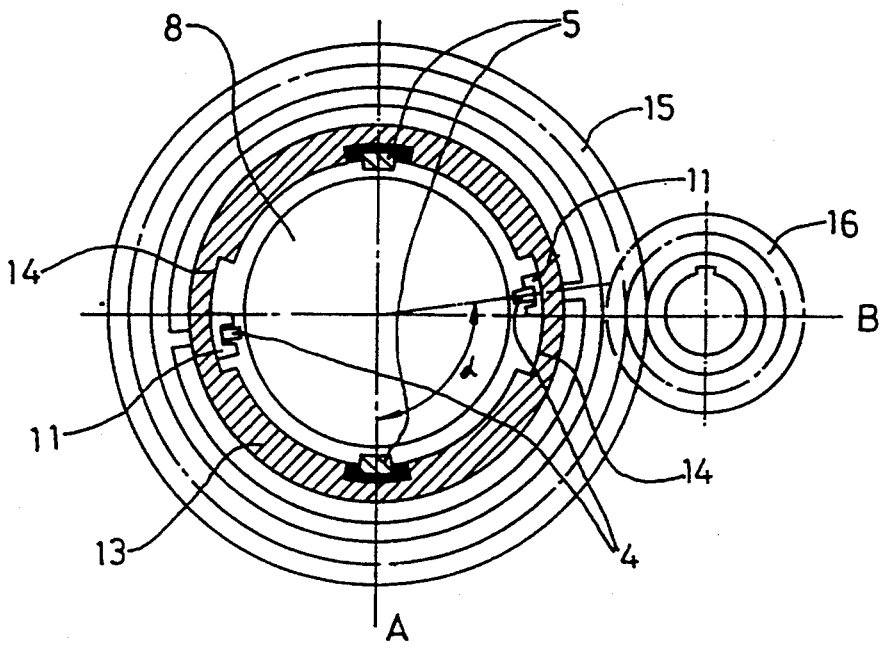
FIG. 7 is a cross-sectional view of a main part of the device shown in FIG. 6.
Figure 8:
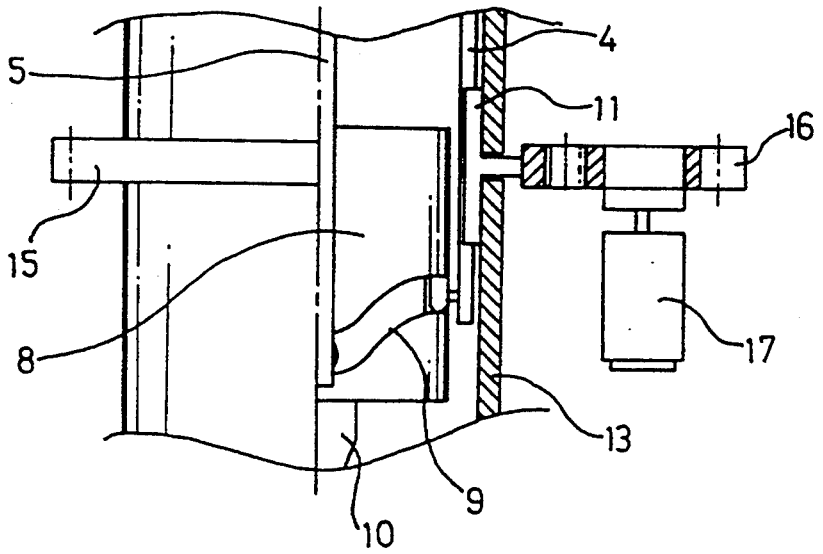
FIG. 8 is a detail view of a main part of the device shown in FIG. 6.

FIGS. 6–8 show a stirling cycle system driving device according to another embodiment of the present invention, in which the circumferential interval between the displacer rod guiding groove 11 and the piston rod guiding groove 12 can be regulated so that the tool phase angle can be regulated even after the device is fabricated.

Said device includes a construction similar to that shown in FIG. 2, except that the displacer rod guiding groove 11 is disposed in a limiting groove 14 formed in the inner surface of the crank case 13 and a following gear 15 is connected incorporate with said displacer rod guiding groove 11 and the following gear 15 is engaged with a driving gear 16 driven by a control motor 17. Therefore, the position of the displacer rod guiding groove 11 can be changed by driving the control motor 17 in a range of being limited by the limiting groove 14, thereby the tool phase angle $\alpha$ can be changed even after the fabrication of the device.

FIGS. 6–8 show a device of the present invention in which the position of the displacer rod guiding groove 11 can be changed, while the displacer rod guiding groove 11 may be formed in a fixed position in the crank case 13 and the position of the piston rod guiding groove 12 can be changed in the limiting groove 12 can be changed in the limiting groove 14, or the displacer rod guiding groove 11 and the piston rod guiding groove 12 may be respectively connected to separate following gears and the position of them may be regulated respectively.

Figure 9:
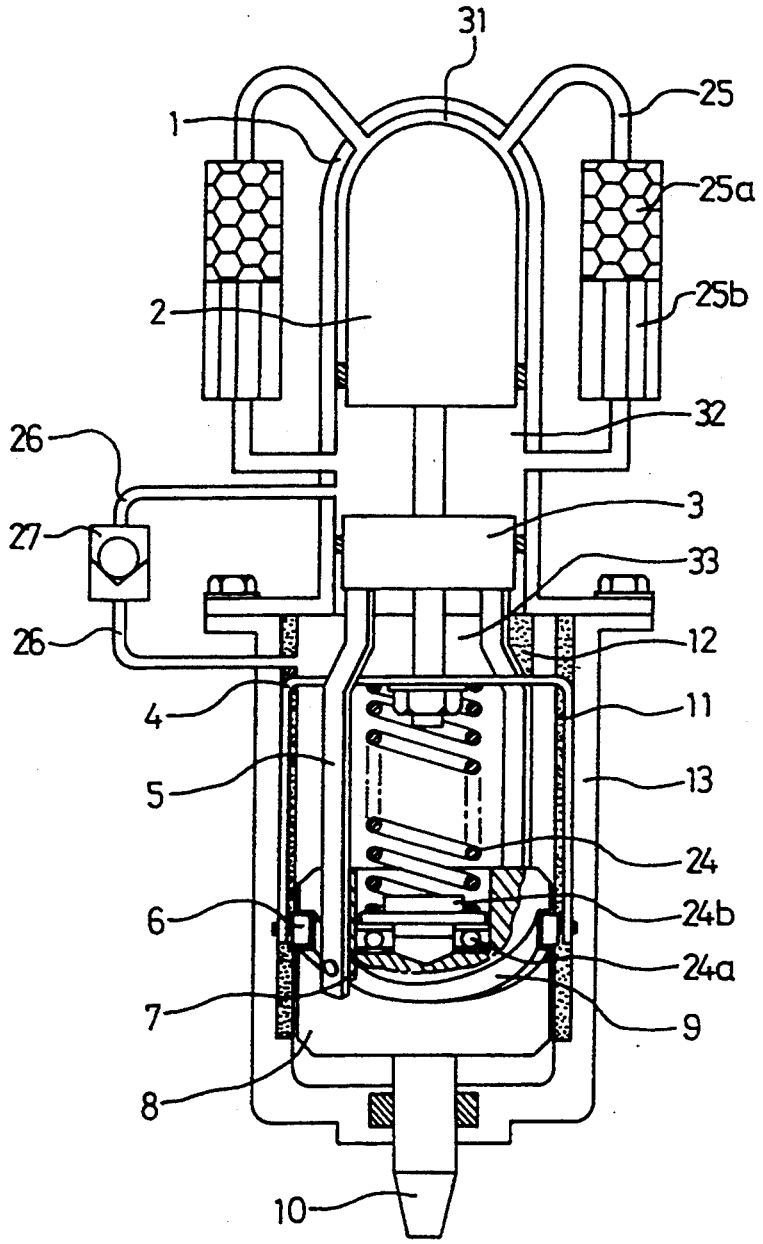
FIG. 9 is a cross-sectional view of the construction of a device according to another embodiment of the present invention comprising a vibration preventing construction for preventing the vibration of displacer rods and piston rods.
Figure 11:
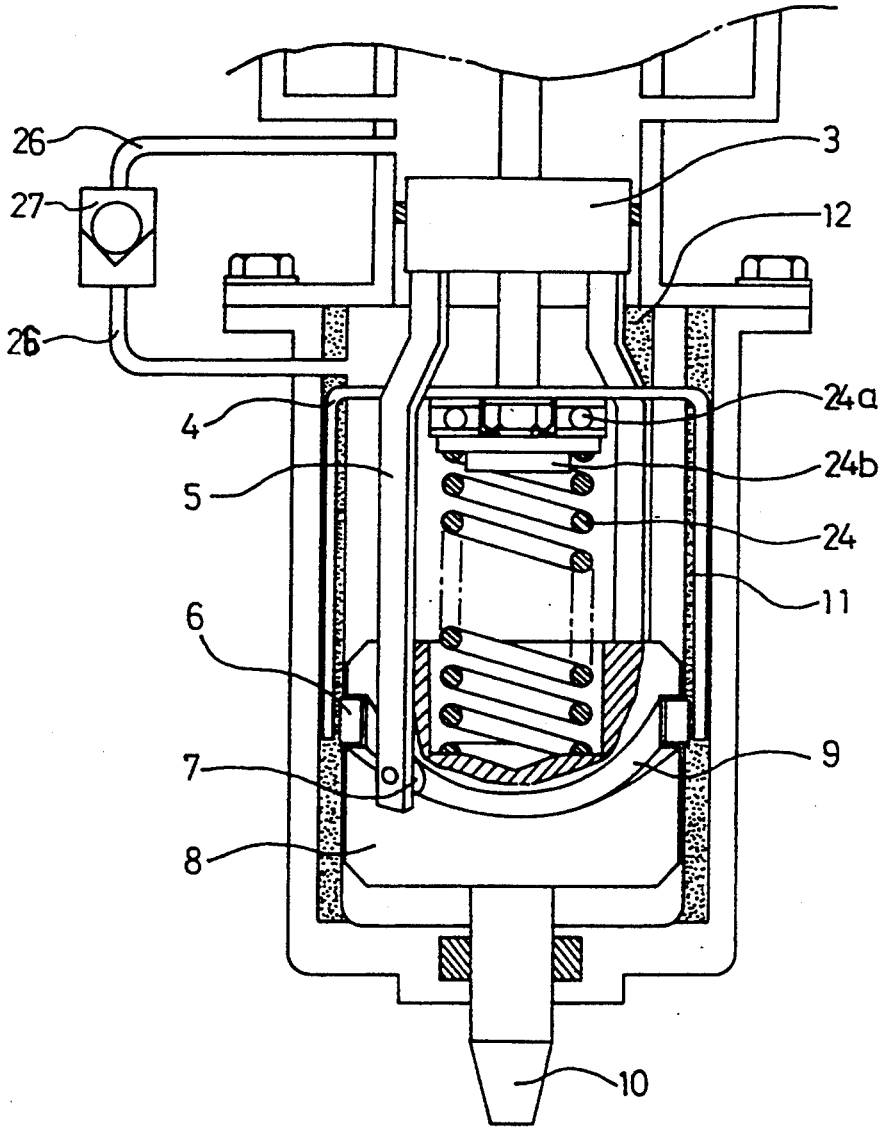
FIG. 11 is a fragmentary sectional view showing the construction of a device according to another embodiment of the present invention comprising another vibration preventing construction for preventing the vibration of piston rods and displacer rods.

FIGS. 9 and 11 show a stirling cycle system driving device according to another embodiment of the present invention which includes a construction for preventing noise and vibration of the device and one side wearing of the circumferential guiding groove 9 due to the gap of the groove 9. The device comprises the same construction as that of the device shown in FIG. 2, except that a connecting line 26 for interconnecting the interior space 33 of the crank case 13 with the compression chamber 32 is provided between the piston 3 and the displacer 2 in the cylinder case 1, that a counterflow preventing valve 27 is disposed midway of the connecting line 26, and that a spring 24 to which initial compression force has been applied is disposed between the circumference cam 8 and the displacer rod 4. The counterflow preventing valve 27 is disposed such that a fluid flow from the interior space 33 of the crank chamber to the compression chamber 32 is permitted and that the inverse flow thereof is not permitted.

Further, a thrust bearing 24*a* and a spring fixing element 24*b* for preventing the rotation of the spring by the rotation of the cam maybe disposed between the circumference cam 8 and the spring 24 as shown in FIG. 9, or between the displacer rod 4 and the spring 24 as shown in FIG. 11.

The reference numerals 25, 25*a*, 25*b*, and 31 designate respectively heat receiving part, a regenerator, a radiator, and an expansion chamber between the displacer and the cylinder case.

The following description will show how the devices according to the embodiments of the present invention described above are driven.

Figure 1:
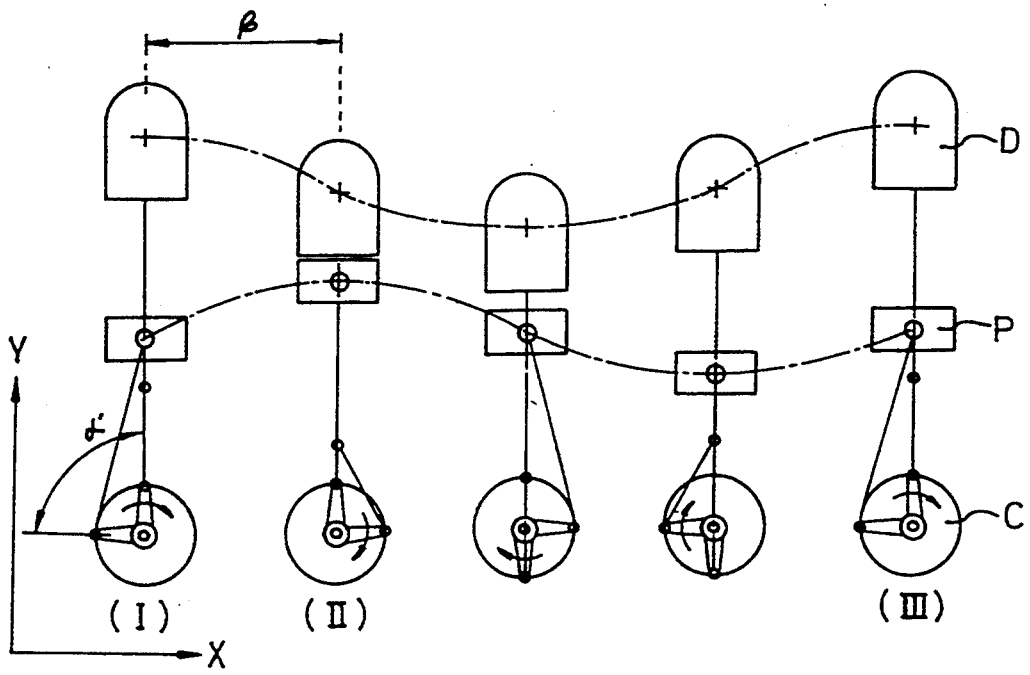
FIG. 1 is a schematic constructional view describing the operating principle of a conventional device.
Figure 3:
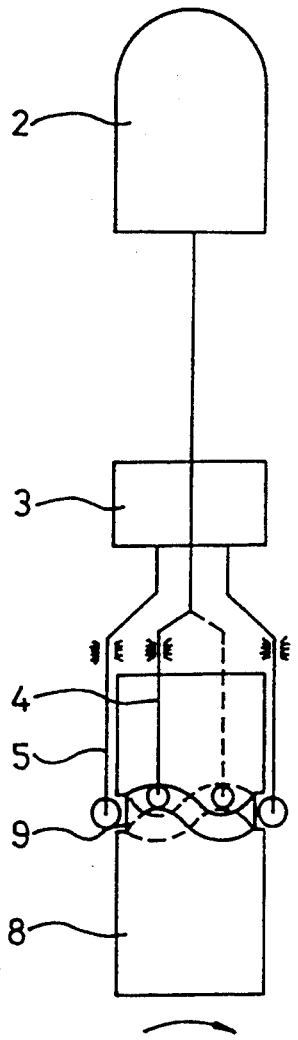
FIG. 3 is a constructional view describing an operating mode of the device shown in FIG. 2.

If a rotating force is applied to the power shaft 10, the circumference cam 8 rotates, thereby the wheels 6 of the displacer rod and the wheels 7 of the piston rod roll in and along the circumferential guiding groove 9, and the displacer rod 4 and the piston rod 5 reciprocate only upward and downward because they are engaged in the displacer rod guiding groove 11 and the piston rod guiding groove 12 respectively. In this case, the angle between the piston rod 5 and the displacer rod 4, which is the tool phase angle $\alpha$, is determined according to the circumferential interval between the displacer rod guiding groove 11 and the piston rod guiding groove 12, and according to this tool phase angle $\alpha$ the track of the stroke volume by the reciprocal action of displacer-piston is determined as is in the description referring to FIG. 1.

The circumferential interval between the displacer rod guiding groove 11 and the piston rod guiding groove 12 can be changed by adopting the construction as shown in FIGS. 6–8. If the driving gear 16 is rotated by driving the control motor 17, rotated according to the driving gear is the following gear 15 engaged in the following gear 15, thereby the position of the displacer rod guiding groove 11 connected incorporate with the following gear 15 can be changed in the range limited by the limiting groove 14. Therefore, even after the device is fabricated, the tool phase angle $\alpha$ can be changed, so that an appropriate track of the stroke volume by the reciprocal action of the displacer 2 and the piston 3 can be regulated.

Figure 12:
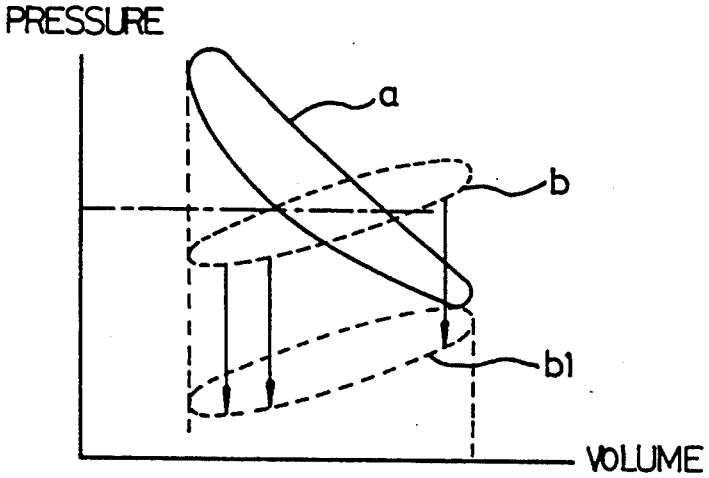
FIG. 12 is a PV diagram of the compression space and the interior of the crank case.

In FIG. 12 showing a PV diagram of the compression chamber 32 in the cylinder case 1 and the interior space 33 of the crank case 13, a closed loop a indicates the PV relation in the compression chamber 32, a closed loop b indicates the PV relation in the interior space 33 of the crank case including no vibration preventing construction, and a closed loop b1 indicates the PV relation in the interior space 33 of the crank case including a vibration preventing construction as shown in FIG. 9 or FIG. 11.

In a device including no vibration preventing construction, the piston rod guiding wheels 7 come into contact with the upper surface or the lower surface of the circumferential guiding groove according to the pressure difference between the compression chamber 32 on the piston and the interior space 33 of the crank case below the piston, and the displacer rod guiding wheels also come into contact with the upper surface or the lower surface of the circumferential guiding groove 9 according to the pressure difference between the expansion chamber 31 and the compression chamber 32.

While, in a device including a vibration preventing construction as shown in FIG. 9 or FIG. 11, if the pressure of the compression chamber 32 is higher than that of the interior space 33 of the crank case 13, the fluid flow from the compression chamber 32 to the space 33 is prevented by the counterflow preventing valve 27, and if the pressure of the space 33 is higher than that of the compression chamber 32, the fluid flows from the space 33 to the compression chamber 32 through the connecting lines 26, thereby the pressure of the compression chamber 32 is always higher than that of the space 33 as apparent through the loop a and the loop b1 in FIG. 12.

Figure 10A:
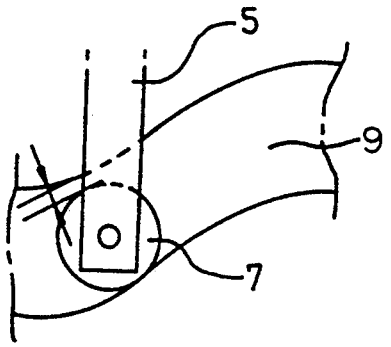
FIG. 10A and FIG. 10B show operating modes of the piston rod wheel and the displacer rod wheel shown in FIG. 9.
Figure 10B:
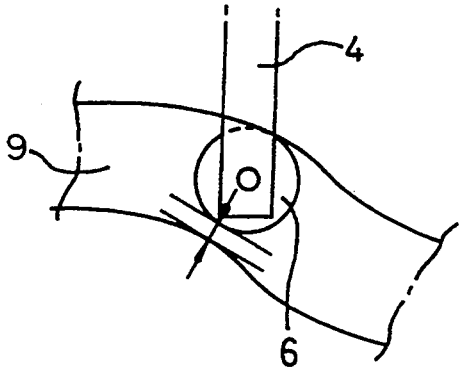

Therefore, the wheels 7 of the piston rod 5 are always in contact with the lower surface of the circumferential guiding groove 9 as shown in FIG. 10A. Meanwhile, between the displacer rod 11 and the circumference cam 8 is disposed a spring which always has a bigger rebounding force than the inertial force produced by the weight and the reciprocating speed of the displacer 2, thereby the wheels 6 of the displacer rod 11 are always in contact with the upper surface of the circumferential guiding groove 9 as shown in FIG. 10B. A thrust bearing 24*a* and a spring fixing element 26*b* are interposed between the spring 24 and the circumference cam 8 as shown in FIG. 9, or between the displacer rod 4 and the spring 24 as shown in FIG. 11, thereby the spring 24 is not rotated by the rotation of the circumference cam 8.

As described above, the stirling cycle system according to the present invention does not include a crank shaft which is included in the conventional device, and does not adopt a piston-displacer separated construction which is adopted in said Ambrose et al's invention. Therefore, the device is minified, the quantity of the working fluid is reduced, and the manufacturing cost decreases. Further, the output power can be regulated by changing the tool phase angle even after the device is fabricated, and vibration and noise of the device, and one side wearing of the surfaces of the circumferential guiding groove are prevented.

Described above is a case that the device according to the embodiments of the present invention operate as a stirling cycle refrigerator driving device in which the displacer 2 and the piston 3 respectively reciprocate upward and downward according to the rotation of the power shaft 10, to the scope of the present invention belongs of course the output power transmitting device of the stirling cycle engine in which the power shaft 10 is rotated by the up-and-down reciprocations of the displacer 2 and the piston 3.

What is claimed is:

1. A stirling cycle system driving device comprising:

a circumference cam having a power shaft connected incorporate to said circumference cam for transmitting a rotating force, and at least one circumferential guiding groove formed on the outer peripheral surface of said circumference cam;

at least one piston rod and at least one displacer rod respectively having a wheel engaged in said at least one circumferential guiding groove, said wheel guided along said at least one circumferential guiding groove by the rotation of said circumference cam;

a crank case including at least one piston rod guiding groove and at least one displacer rod guiding groove which are spaced out at a predetermined circumferential interval apart, and which respectively guide said piston rod and said displacer rod so that said piston rod and said displacer rod can only reciprocate upward and downward;

a piston and a displacer which are respectively connected to said piston rod and said displacer rod, and which reciprocate upward and downward when said wheels are guided along said at least one circumferential guiding groove by the rotation of said circumference cam; and a cylinder case enclosing said piston and said displacer, and including an expansion space defined by said displacer and said cylinder case, and a compression space defined by said displacer and said piston.

2. A stirling cycle system driving device as claimed in claim 1, wherein said at least one piston rod and at least one displacer rod comprises one piston rod and one displacer rod.

3. A stirling cycle system driving device as claimed in claim 1, wherein at least one circumferential guiding groove comprises two circumferential guiding grooves are formed on the outer peripheral surface of said circumference cam, and the wheel of said piston rod is engaged in one of said two circumferential guiding grooves, the wheel of said displacer rod being engaged in the other of said two circumferential guiding grooves.

4. A stirling cycle system driving device as claimed in claim 1 further comprising regulating means for regulating the circumferential interval between said piston rod guiding groove and said displacer rod guiding groove.

5. A stirling cycle system driving device as claimed in claim 4, wherein said regulating means comprises a following gear connected to said displacer rod guiding groove, a driving gear engaged with said following gear, and a control motor for driving said driving gear, and said piston rod guiding groove is formed in a fixed position in said crank case.

6. A stirling cycle system driving device as calmed in claim 5, wherein said crank case has a limiting groove formed therein, and said displacer rod guiding groove is disposed in said limiting groove, the position of said displacer rod guiding groove limited by said limiting groove.

7. A stirling cycle system driving device as claimed in claim 4, wherein said regulating means comprises a following gear connected to said piston rod guiding groove, a driving gear engaged with said following gear, and a control motor for driving said driving gear, and said displacer rod guiding groove is formed in a fixed position in said crank case.

8. A stirling cycle system driving device as claimed in claim 7, wherein said crank case has a limiting groove formed therein, and said piston rod guiding groove is disposed in said limiting groove, the position of said piston rod guiding groove limited by said limiting groove.

9. A stirling cycle system driving device as claimed in claim 1 further comprising:

a connecting line interconnecting said compression space and the interior space of said crank case; and a counterflow preventing valve which is disposed in midway of the connecting line and prevents the working fluid from flowing from said compression space to the interior space of said crank case.

10. A stirling cycle system driving device as claimed in claim 9 further comprising a spring which is disposed between said displacer rod and said circumference cam and provides an upward force for said displacer rod.

11. A stirling cycle system driving device as claimed in claim 10 further comprising a thrust bearing and a spring fixing element for preventing said spring from rotating, which are disposed between said spring and said circumference cam.

12. A stirling cycle system driving device as claimed in claim 10 further comprising a thrust bearing and a spring fixing element for preventing said spring from rotating, which are disposed between said spring and said displacer rod.

* * * * *